United States Patent [19]

Eckert et al.

[11] 4,434,012

[45] Feb. 28, 1984

[54] TREATING ARTICLES IN AN ARRAY WITH STREAMS OF A MEDIUM

[75] Inventors: Robert J. Eckert, Oley; Frederick R. Keene, Jr., Reading, both of Pa.

[73] Assignee: Western Electric Co., Inc., New York, N.Y.

[21] Appl. No.: 388,575

[22] Filed: Jun. 15, 1982

[51] Int. Cl.[3] ..... B08B 3/02; B08B 11/02

[52] U.S. Cl. ..... 134/25.4; 134/25.5; 134/34; 134/42; 134/198; 134/201; 51/410; 118/300; 269/21; 269/903; 427/421

[58] Field of Search ..... 134/25.2, 25.3, 25.4, 134/25.5, 34, 42, 172, 198, 201; 51/410, 427; 118/300; 427/421; 269/21, 903; 279/3

[56] References Cited

U.S. PATENT DOCUMENTS 366,820 7/1887 Donner ..... 134/34 X 3,489,608 1/1970 Jacobs et al. ..... 134/25.4

*Primary Examiner*—Marc L. Caroff

*Attorney, Agent, or Firm*—D. C. Watson

[57] ABSTRACT

Articles such as substantially flat, electronic chips (10) are positioned in an array with surfaces (11) to be treated facing upward along a succession of specially selected tiers. Such tiers may preferably be horizontal rows (20–24) of top rims (19) of vertical suction tubes (18). A leading row (20) of such top rims (19) is at a first elevation and each succeeding row is parallel to, elevated above and offset horizontally from a preceding row in stepwise fashion. At least one nozzle (40) is provided for propelling a stream (52) of a treating medium upon and at an angle "H" to the surfaces (11) to be treated. Angle "H" is selected so the medium and any dislodged matter is deflected from the respective surfaces (11) without contacting other such surfaces (11) of chips (10) positioned for treatment in the array.

9 Claims, 2 Drawing Figures

TREATING ARTICLES IN AN ARRAY WITH STREAMS OF A MEDIUM

TECHNICAL FIELD

This invention relates to treating articles with streams of a medium. More particularly, the invention relates to treating articles such as by cleaning surfaces thereon with propelled streams of a medium, e.g., by directional jets of a fluid solvent. The invention further relates to the transfer to and secure positioning of such articles in advantageous arrays for such treatment.

BACKGROUND OF THE INVENTION

In industry, articles are sometimes treated by subjecting them to propelled streams of media as opposed to immersion in baths of fluid or chambers containing gases or steam. Such propelled streams may include blasts of particles for frictional effect or jets of steam, water or other solvents with or without friction producing particles. One reason for utilizing propelled streams is to forcefully dislodge matter which would require a long time to dissolve in a bath. Another reason is to minimize cross-contamination caused by a transfer of dislodged matter between articles.

Significant handling problems may be involved in the treatment of some small articles. For example, chips of material used in solid state electronic devices are so miniature and light in weight that it is difficult to individually manipulate and securely hold one article separately from another. Moreover, for routine treatment such as cleaning, rinsing and drying, it is not normally economically feasible to handle such chips on an individual basis. Accordingly, nearly all solid state chips, e.g., silicon, germanium and garnet chips, are treated extensively while they are still a part of a much larger wafer. Once such chips are separated from a wafer, they receive little further attention until they are bonded to a substrate or otherwise incorporated into a device package. Of course while chips are waiting to be packaged or when they are shipped between manufacturing facilities, they should be protected in some sort of container.

A practical method of handling solid state chips which are expensive enough to warrant special protection, such as from being abraded by commingling in a container, is to place them individually in pockets in a carrier. One such carrier has a flat, rectangular configuration with a plurality of recessed pockets and a clear cover. Such carriers are made of several types of plastic, they are inexpensive and easy to handle and sometimes include drain apertures in the pockets to facilitate washing chips therein. Some suppliers provide plastic screens to replace the covers so cleaning solutions will pass readily over the chips during an immersion cleaning process while in the carrier. However, not all chips are satisfactorily cleaned by such immersion type cleaning. In particular, garnet chips containing magnetic bubble memory circuits are sometimes more efficiently cleaned by directing propelled streams of solvents upon delicate active surfaces while they are separately positioned in special arrays.

Accordingly, it is desirable to develop new and improved expedients for treating surfaces of articles with streams of a medium. It is further desirable to position the articles in special arrays so that the medium and any dislodged matter deflected from respective surfaces are not transferred to other surfaces being cleaned. It is also advantageous to transfer miniature articles such as solid state chips directly from available carriers onto cleaning fixtures without abrading delicate active surfaces on the chips.

SUMMARY OF THE INVENTION

In accordance with the instant invention, expedients are provided to treat surfaces of articles in an array. Such articles are positioned with surfaces to be treated facing upward along a succession of tiers which may be horizontal rows of top rims of vertical suction tubes. A leading tier of such top rims is at a first elevation and each succeeding tier is parallel to, elevated above and offset horizontally from a preceding tier in stepwise fashion. Expedients are provided for propelling a stream of a treating medium upon and at an angle to the surfaces to be treated. The angle is selected so the medium with any dislodged matter is deflected from the respective surfaces without contacting other such surfaces of articles positioned for treatment in the array.

In one embodiment the articles are substantially flat and the array is produced by placing the articles in a carrier having an array of pockets complementary to a desired plan view of the array of articles to be treated. Each pocket holds an article therein with a major surface to be treated facing upward and another major, supporting surface facing downward over a bottom aperture in a respective pocket. The carrier thusly containing the articles is disposed over and lowered upon the array of vacuum tubes whereupon each tube enters an aperture in a corresponding pocket. The top rim of each tube comes into vacuum secured engagement with the major supporting surface of a respective article. The lowering continues until each article is securely engaged upon the top rim of its respective tube and the now empty carrier rests at the base of the tubes.

BRIEF DESCRIPTION OF THE DRAWING

The invention will be more readily understood from the following detailed description when read in conjunction with the accompanying drawing, wherein.

Figure 1:
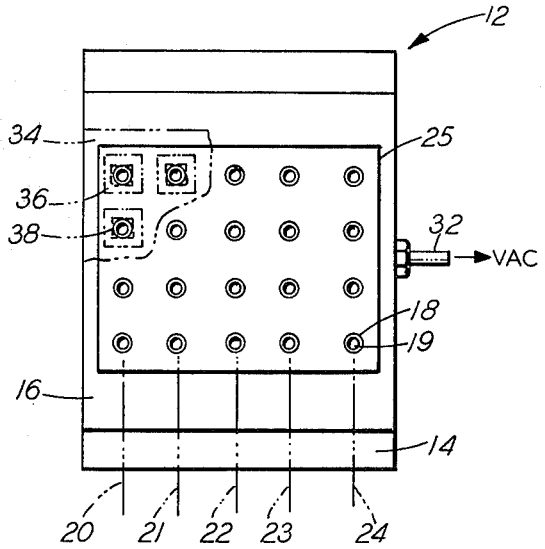
FIG. 1 is a plan view of a fixture which may be utilized for positioning articles to be treated in accordance with the instant invention.

It can be seen that some elements in the figures are abbreviated or simplified to highlight certain features of the invention. Also, where appropriate, reference numerals have been repeated in the figures, to designate the same or corresponding features in the drawing.

DETAILED DESCRIPTION

The Articles

Figure 2:
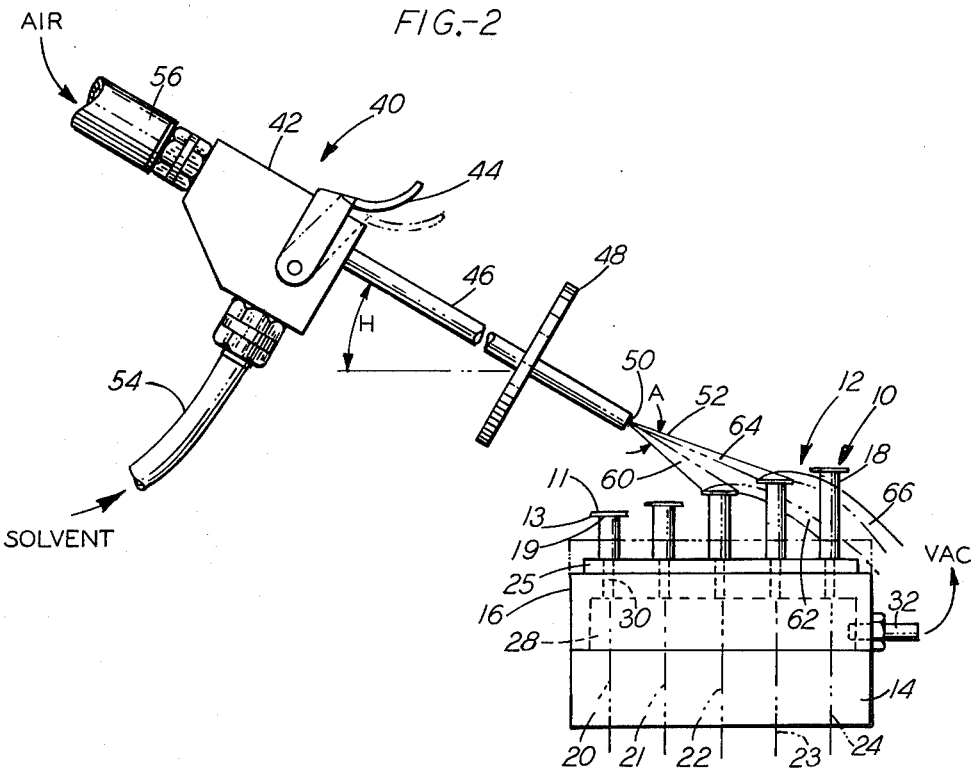
FIG. 2 is an elevation view of the fixture shown in FIG. 1, depicting a condition wherein the articles are in position and a stream of a medium is being propelled upon surfaces being treated.

FIG. 2 shows several articles 10, each having at least a major surface 11 which is treated with at least one stream of a medium in the practice of the invention. For purposes of illustration and discussion, such an article 10 will also be referred to herein as a solid state chip 10 or merely as a chip 10. Such chips 10 are typically substantially flat because they are cut from wafers of monocrystalline material and the wafers are ground and polished on both sides to achieve a high degree of planarity. Then electronic devices are processed into one active major surface 11 and another, substantially parallel major surface 13 is utilized for supporting the wafer.

For further descriptive purposes, chip 10 will also often be considered herein as a chip of gadolinium gallium garnet (GGG) which is presently preferred in the production of magnetic bubble type memory devices in electronics work. Such a chip may be about 0.240 inch square by about 0.010 inch thick and weigh about 0.05–0.06 grams. The memory devices in such a chip represent a solid state, high density, nonvolatile method of storing information. Each chip may store about 68,000 bits in memory and four such chips are often incorporated into a dual in-line package.

Before the chips 10 are separated from a wafer, a multitude of process steps are performed upon their active major surfaces 11. After the chips 10 are separated, they are categorized so that a group of four chips in a package all have about the same level of sensitivity to externally applied magnetic fields. Consequently, there is a large investment in good chips 10 which survive testing and special treatment is well warranted.

Such special treatment includes a cleaning operation to remove matter from dense, delicate features on the exposed active surfaces 11. Such matter includes particles of GGG generated by the separation process which may be sized in the submicron range and which tightly cling to the active surfaces 11, probably because of static electricity, magnetism and similar complex causes. A problem is to remove such matter without risking abrasion to the active surfaces by touching such surfaces with fingers or tools or, for example, by permitting like articles to commingle and rub together in a common unstructured container. Another problem is to remove such matter without transferring dislodged matter from respective surfaces to other surfaces being cleaned.

While the articles 10 and the treating problems associated therewith have been described above with respect to chips 10 of GGG, it is believed apparent from the discussion herein that the invention is not so limited. For example, in modern electronics work chips of silicon often take on great value such that special treatment after separation from a wafer may be warranted. Nor are the articles 10 limited to electronics work in the practice of the invention. There are many fine articles throughout industry that warrant individual attention and somewhat rigorous treatment such as by propelled streams of media. However, it is presently preferred to describe the invention with respect to electronic chips 10 and particularly with respect to chips 10 of GGG because of the challenges associated therewith.

Positioning the Articles

FIGS. 1 and 2 show plan and elevation views, respectively, of a fixture 12 for securely positioning a plurality of articles 10 with surfaces 11 to be treated facing upward. The fixture 12 includes a base 14 on which is mounted a member 16 having several functions. For example, member 16 supports a plurality of pedestals in the form of tubes 18 for securely engaging the articles 10.

It can be seen in FIG. 2 that each of the tubes 18 has a smooth top rim 19 which defines a plane for supporting an individual article 10 thereon. It is also seen that the tubes 18 are aligned in parallel rows 20–24, each containing four positions to form a desired array of top rims 19. Note that the leading row 20 has top rims 19 ending along a first elevation and each succeeding row 21–24 has top rims 19 ending along a uniform elevation above and offset horizontally from top rims 19 in a preceding row in stepwise fashion. In the fixture 12 shown in FIG. 2, the difference in elevation between top rims in succeeding rows may be, for example, about 0.06 inch and the rows 20–24 are set about 0.36 inch on centers. The tubes 18 are set in a raised portion 25 of member 16 for reasons to be explained later.

Referring to FIG. 2, it can be seen that members 16 have an interior hollow chamber 28 and the tubes 18 have passageways 30 communicating with chamber 28. An external hose connection 32 also is adapted for communication with chamber 28 and, via a hose to a vacuum source (neither being shown).

Referring also to FIG. 1, there is seen in phantom outline a carrier 34 for separately handling chips 10 in a desired array. Carrier 34 includes a plurality of pockets 36 each of which are sized and recessed to receive a chip 10 therein. For example, a chip 10 is horizontally disposed in a pocket 36 with a major surface 11 to be treated facing upward and, substantially parallel thereto, another major surface 13 facing downward. Surface 13 has utility for supporting chip 10 during processing and when the chip is mounted for service in a package. It can be seen that each pocket 36 has a desired bottom aperture 38 which is generally provided to drain fluids used to wash chips. Such aperture 38 is advantageously utilized in the practice of the invention to assist in positioning a chip 10 for treatment as will be explained later. Carrier 34 is often provided with a clear cover and retention clips which combine to retain the chips in place and keep out undesirable foreign matter. A carrier 34 of the type described is sold by Fluoroware Division of F.S.I. Corp., Chaska, Minn. as its Model H20 Chip Tray in several configurations and varieties of plastic material.

It will be readily seen in the practice of the invention that an array of chips 10 in a carrier 34 is complementary to, but somewhat different than, an array of chips 10 positioned for treatment on fixture 12. For example, after the chips 10 are loaded into a carrier 34, the carrier 34 may be clipped and thereby sealed for storage, shipping or other operations. In due course the carrier 34 may be utilized to position the chips 10 on the fixture 12 after the unseen cover has been removed.

The carrier 34 is disposed over the fixture whereby it is seen that the array of chips in the pockets 36 is complementary to a desired plan view of an array of articles to be treated. The carrier 34 and chips 10 are then lowered such that each tube 18 enters an aperture 38 in a corresponding pocket 36 in the array. The top rim 19 of each tube 18 comes into vacuum secured engagement with the major supporting surface 13 of a respective chip 10. Such lowering of carrier 34 continues until each chip 10 is securely engaged upon the top rim 19 of its respective tube 18. The now empty carrier 34 is rested upon the raised portion 25 of member as shown in FIG. 2. Portion 25 of member 16 may be varied in size to suit a particular carrier such that the carrier itself rests without being tilted and without bouncing around when it is later cleaned and dried as part of a process for treating the chips 10.

It can be seen that the chips 10 in FIG. 2 are securely positioned in a desirable array for a spray cleaning treatment. A vacuum drawn through nozzle 32, chamber 28 and passageways 30 securely holds the chips 10 on fixture 12 in the stepped array described. Such apparatus has proven desirable for maintaining the positions of the chips 10 for the treatment to be described.

Treating the Articles

FIG. 2 illustrates advantageous expedients for treating, with at least one stream of a medium, active surfaces 11 of garnet chips 10 for bubble memory work. A spray nozzle 40 has a valve 42 operated by a trigger 44, a delivery tube 46 and a hand protective shield 48. Tube 46 contains a delivery end 50 having about a 0.031 inch bore (not shown) which delivers a stream 52 having a generally conical pattern which disperses in an overall angle "A" of about 15±3 degrees as it leaves tube 46.

Although many different media may be utilized for a chip treatment process, it has been found desirable in garnet work to utilize a mixture of solvents sold under the trade designation Freon TE-35 by E. I. Dupont De Nemours of Wilmington, Del. It is believed that Freon TE-35 is a very refined blend of ethanol and trichlorotrifluoroethane.

It has been found desirable to draw the Freon TE-35 into valve 42 through a tube 54 from a source (not shown) by aspiration. The aspirating medium may be compressed air which in this case is delivered from a source (not shown) through a tube 56 at about 30 to 35 psig to valve 42. Such air is also heated with a 100 watt heater (not shown) to facilitate drying of chips 10 after cleaning. A similar nozzle 40 and associated equipment for spraying solvents is sold by Cobehn, Inc. of 226 Passaic St., Fairfield, N.J.

In operation of the apparatus shown in FIGS. 1 and 2, the chips 10 are placed in carrier 34 and when cleaning is desired, the vacuum to fixture 12 is first applied before the chips 10 are transferred thereto. The chips 10 are placed into the desired stepped array in accordance with the steps previously described. It is incidentally noted in the embodiment shown that all tubes 18 are covered with chips 10 to avoid having air enter an uncovered tube 18 and diminish the strength of vacuum drawn in chamber 28. However, it is within the spirit of the invention to utilize valved tubes 18 or to fill unneeded pockets 36 in a carrier 34 with blank members such as aluminum plates to cover unused tubes 18.

After the chips 10 are positioned on fixture 12 in the desired array and in vacuum secured engagement the treatment may begin. The air pressure is applied to nozzle 40 and the delivery tube is held at an angle "H" of about 30±10 degrees to the planar orientation of the chips 10. The end 50 is held at about 0.5 inch from a target row of chips 10 and trigger 44 is depressed as shown in phantom. The solvent is aspirated into valve 42 and delivered at the desired angle to the active surfaces 11 of the chips 10. Of course the nozzle 40 is manipulated such that the stream 52 is directed over the chips 10 until all surfaces 11 are cleaned according to a desired standard. The carrier 34 which is shown resting on raised portion 25 in the drawing may also be cleaned during the treatment. Then trigger 44 is somewhat released and heated air is delivered in the same manner upon the surfaces 11 to remove the cleaning solvent. When the cleaning is completed the carrier 34 is gently raised upward and all chips 10 are repositioned in carrier 34 whereby there is no need for contact to the surfaces 11 by human fingers or tools.

Certain aspects of the spray pattern 52 and the positioning of the chips 10 during the treatment process are worthy of note. For example, the spray pattern can be theoretically divided as shown in FIG. 2 to show that the stream of solvent medium is propelled along at least first and second incident paths.

A first such path is designated by the numeral 60 and is directed toward a first surface 11 aligned such that the medium strikes such surface 11 and is redirected therefrom, with any dislodged matter, along a first deflection path designated by the numeral 62. A second incident path is designated by the numeral 64 and is directed toward a second surface 11 aligned such that the medium strikes such surface 11 and is redirected therefrom, with any dislodged matter, along a second deflection path designated by the numeral 66. It is evident that the positions of the chips 10 are selected to avoid having the surfaces 11 to be treated exposed to medium or matter redirected along the deflection paths. It is incidentally seen that certain portions of the pattern 52 may not strike a surface 11.

It will be appreciated that the type of medium being utilized, the spray pattern 52, the angle "A" and "H", the size of the chips 10 and the stepped array are somewhat interrelated factors. The relationships given in the description have been found suitable for the illustrative embodiment shown in the drawing and described herein. Nevertheless, it is believed evident that one of ordinary skill in the art can, with little experimentation, vary the related factors to suit different articles 10 and different media in the practice of the invention.

There have been illustrated herein certain embodiments of the invention and certain applications thereof. Nevertheless, it is to be understood that various modifications and refinements may be made and used which differ from these disclosed embodiments without departing from the spirit and scope of the present invention.

For example, the articles 10 could be secured in the preferred positions by other expedients such as by suction cups or by magnetism. Also, the articles 10 need not be flat, nor do the surfaces 11 have to be flat provided such articles are positioned so the surfaces to be cleaned are in a tiered arrangement suitable to the stream of a medium and its angle striking such surfaces. Furthermore, when it is set forth herein that the tiers are horizontal, what is meant is that the tiers are preferably substantially horizontal but that reasonable deviations therefrom are within the scope of the described embodiment.

Of course, a stream of a medium should have a predictable pattern and force with respect to the surfaces being treated. However, the medium need not be an airborne solvent but could, for example, be a stream of another fluid with or without friction producing particles.

What is claimed is:

1. Apparatus for treating surfaces of articles with at least one stream of a medium, comprising:

means for propelling the stream of medium along at least first and second incident paths;

means for positioning at least one first article having a first surface to be treated aligned such that the medium directed along the first incident path strikes said surface and is redirected therefrom, with any dislodged matter, along a first deflection path;

means for positioning at least one second article having a second surface to be treated aligned substantially parallel to and offset perpendicularly a given distance from the first surface of the first article such that the medium directed along the second incident path strikes the second surface and is redirected therefrom, with any dislodged matter, along a second deflection path, the positions of the articles being selected to avoid having the surfaces to be treated exposed to medium and matter redirected along the deflection paths.

2. Apparatus in claim 1, wherein each article is substantially flat such that the first surface to be treated is a major surface and another substantially parallel, major surface is utilized for positioning the article.

3. Apparatus as in claim 2, wherein the means for propelling the stream of medium further comprises:

means for directing said medium along a path incident to a respective surface to be treated such that substantially all portions of said path form an acute angle with said surface measured in a plane passing through the centerline of the stream and normal to said surface.

4. Apparatus as in claim 3, wherein the means for positioning at least one first article further comprises:

means for positioning a plurality of first articles having first surfaces aligned along a first horizontal tier; and wherein the means for positioning at least one second article includes means for positioning a plurality of second articles having second surfaces aligned along a second horizontal tier substantially parallel to and offset a given vertical distance from the first surfaces of the first articles, said second articles also being offset a given horizontal distance from the first articles sufficient to substantially fully expose the first surfaces to the medium being propelled along the first incident path without presenting the second surfaces to medium and matter being redirected along the first deflection path including any fallout therefrom caused by gravitational force.

5. Apparatus for treating surfaces of articles in an array thereof, comprising:

means for positioning the articles having surfaces to be treated facing upward along a succession of horizontal tiers, a leading tier being at a first elevation and each succeeding tier being parallel to, elevated above and offset horizontally from an immediately preceding tier in stepwise fashion; and means for propelling at least one stream of a treating medium upon and at such an angle to the surfaces to be treated that such medium with any dislodged matter is deflected from the respective surfaces without contacting other such surfaces of articles positioned for treatment in the array.

6. Apparatus as in claim 5, wherein the articles are substantially flat, each having a major surface to be treated and, substantially parallel thereto, another major surface having utility for supporting and positioning the articles and wherein the means for positioning the articles further comprises:

a fixture supporting an array of vertically extending hollow tubes, each having a smooth top rim defining a plane for supporting an individual article thereon, the tubes being disposed along successive parallel rows with a leading row having top rims ending along a first elevation and each succeeding row having top rims ending along a uniform elevation above and offset horizontally from top rims in a preceding row in stepwise fashion; and means for drawing a vacuum in each tube sufficient to securely hold an article in position on a top rim thereof when a stream of medium is propelled upon exposed major surfaces of the articles for treatment.

7. A method of treating surfaces of articles in an array thereof, comprising:

positioning the articles having surfaces to be treated facing upward along a succession of horizontal tiers, a leading tier being at a first elevation and each succeeding tier being parallel to, elevated above and offset horizontally from an immediately preceding tier in stepwise fashion; and propelling at least one stream of a treating medium upon and at such an angle to the surfaces to be treated that such medium and any dislodged matter is deflected from the respective surfaces without contacting other such surfaces of articles positioned for treatment in the array.

8. The method as in claim 7, wherein the step of positioning the articles further comprises:

supporting an array of vertically extending hollow tubes, each having a smooth top rim defining a plane for supporting an individual article thereon, the tubes being disposed along successive parallel rows with a leading row having top rims ending along a first elevation and each succeeding row having top rims ending along a uniform elevation above and offset horizontally from top rims in a preceding row in stepwise fashion; and drawing a vacuum in each tube sufficient to securely hold an article in position on a top rim thereof when a stream of medium is propelled upon exposed major surfaces of the articles for treatment.

9. The method as in claim 8, wherein the articles are substantially flat and the array thereof is produced by the steps of:

placing the articles in a carrier having an array of pockets complementary to a desired plan view of the array of articles to be treated, each pocket holding an article horizontally disposed therein with a major surface to be treated facing upward and, substantially parallel thereto, another major surface having utility for supporting the article facing downward over a desired bottom aperture in each respective carrier pocket;

disposing the carrier containing the articles in the complementary array over the array of vacuum tubes; and lowering the carrier such that each tube enters an aperture in a corresponding pocket in the array and the top rim of such tube comes into vacuum secured engagement with the major supporting surface of a respective article, such lowering continuing until each article is securely engaged upon the top rim of its respective tube and the now empty carrier rests at the base of the tubes.

* * * * *

UNITED STATES PATENT AND TRADEMARK OFFICE

CERTIFICATE OF CORRECTION

PATENT NO. : 4,434,012

DATED : February 28, 1984

INVENTOR(S) : R. J. Eckert, F. R. Keene, Jr.

It is certified that error appears in the above—identified patent and that said Letters Patent is hereby corrected as shown below:

Title page, References Cited, U.S. Patent Documents. The following references were omitted:

| | | | |
|---|---|---|---|
| 2,680,994 | 6/1954 | Wood | 269/21 |
| 3,558,093 | 1/1971 | Bok | 248/362 |
| 3,809,050 | 5/1974 | Chough et al. | 125/35 |
| 4,066,249 | 1/1978 | Huber | 269/21 |
| 4,088,312 | 5/1978 | Frosch et al. | 269/21 |
| 4,213,698 | 7/1980 | Firtion | 355/77 |

Signed and Sealed this

Twenty-fourth Day of July 1984

[SEAL]

*Attest:*

GERALD J. MOSSINGHOFF

*Attesting Officer*

*Commissioner of Patents and Trademarks*